US012584710B2

(12) United States Patent
van der Merwe

(10) Patent No.: US 12,584,710 B2
(45) Date of Patent: Mar. 24, 2026

(54) ADJUSTABLE, INTERCHANGEABLE HOLSTER

(71) Applicant: Johan Hendrick Georg van der Merwe, Gerhardsville (ZA)

(72) Inventor: Johan Hendrick Georg van der Merwe, Gerhardsville (ZA)

( * ) Notice: Subject to any disclaimer, the term of this patent is extended or adjusted under 35 U.S.C. 154(b) by 123 days.

(21) Appl. No.: 18/524,407

(22) Filed: Nov. 30, 2023

(65) Prior Publication Data

US 2024/0175659 A1 May 30, 2024

(30) Foreign Application Priority Data

Nov. 30, 2022 (ZA) ..... 2022/12980

(51) Int. Cl.
*F41C 3/04* (2006.01)
*F41C 33/02* (2006.01)
*F41C 33/04* (2006.01)

(52) U.S. Cl.
CPC ..... *F41C 33/041* (2013.01); *F41C 33/0209* (2013.01)

(58) Field of Classification Search
CPC ..... F41C 33/041; F41C 33/0209; F41C 33/0236; F41C 33/0272; F41C 33/02; F41C 33/0227; F41C 33/045; F41C 33/0245; F41C 33/043
USPC ..... 224/192
See application file for complete search history.

(56) References Cited

U.S. PATENT DOCUMENTS

| | | | | | |
|---|---|---|---|---|---|
| 3,923,214 | A * | 12/1975 | Kippen | F41C 33/0209 | 224/911 |
| 5,265,781 | A * | 11/1993 | Nichols | F41C 33/0227 | 224/198 |
| 9,086,254 | B1 * | 7/2015 | Plappert | F41C 33/041 | |
| 10,415,927 | B1 * | 9/2019 | Shults | F41C 33/043 | |
| 2016/0231081 | A1 * | 8/2016 | Evans | F41C 33/041 | |
| 2020/0232756 | A1 * | 7/2020 | Hamilton | F41C 33/0236 | |
| 2024/0011734 | A1 * | 1/2024 | DeRenzo | F41C 33/0236 | |
| 2024/0175659 | A1 * | 5/2024 | van der Merwe | F41C 33/0209 | |

* cited by examiner

*Primary Examiner* — Jack W Lavinder
(74) *Attorney, Agent, or Firm* — Scott R. Cox

(57) ABSTRACT

A passive retention holster including a holster body and at least one compatible holster accessory, wherein the holster body includes a cavity, configured to realisably receive and retain a preselected handgun frictionally therein. The holster body is provided with a first adjustable attachment formation, located on one side of the holster body, wherein the first attachment formation is dimensioned and configured to render the body operatively securable, adjustably, to the compatible holster accessory; and a second adjustable attachment formation, located on an opposing side of the holster body, relative to the first attachment formation, wherein the second attachment formation is dimensioned and configured to render the body operatively securable, adjustably, to the compatible holster accessory. The compatible holster accessory is provided with a corresponding attachment formation, dimensioned and configured to render the compatible holster accessory operatively securable to the opposing sides of the holster body.

13 Claims, 20 Drawing Sheets

ADJUSTABLE, INTERCHANGEABLE HOLSTER

FIELD OF THE INVENTION

The invention relates to an adjustable, interchangeable holster. More particularly but not exclusively, the invention relates to an interchangeable handgun holster with a plurality of positional arrangements.

BACKGROUND TO THE INVENTION

Many handgun users, particularly military and law enforcement personnel, carry a handgun in a holster designed to protect the handgun and hold it securely. Holsters can be worn in a number of ways and in a variety of locations on a user's body, such as at the waist, on the thigh, around an ankle, under an arm or on the chest.

Generally, handgun users must be able to remove the handgun quickly and easily from its holster regardless of the type of holster used, or the location of the holster on the user's body. Additionally, users need to be assured that, when not in use, the handgun will remain safely and securely in the holster. Handgun users must further also be able to secure and/or re-secure the handgun in the holster quickly and easily when it is not being used.

Some holsters rely solely on a friction fit between the holster and the handgun to secure and retain the handgun securely within the holster. These types of holsters are generally not suitable for situations where the gun/holster is subject to a great deal of movement, as such movement could cause the handgun to lose frictional engagement with the holster and allow the handgun to dislodge from the holster. These holsters are known as passive retention holsters.

Certain other holsters include a variety of strap and/or flap arrangements that prevent the removal and/or dislodgement of the handgun from the holster while such straps and/or flaps are in place. Generally, with designs that rely on strap and/or flap arrangements to retain a handgun, the user must first unfasten and/or rotate a strap, or unfasten and open a flap before the handgun can be removed. The user similarly might have to move the strap and/or flap before the handgun can be re-holstered, typically causing or requiring the user to look down at the holster and take his or her eyes off of a possible threat or target. Then, once the handgun has been re-holstered, the user must physically reposition and refasten the strap and/or flap before the handgun is retained securely within the holster. These holsters are known as active retention holsters.

Active retention holsters require a specific action beyond the draw of the handgun to remove the handgun from the holster, and typically require the moving of specific components to aid the selective retention or removal of the handgun. Generally and in most use cases, users would prefer to be able to simply draw the handgun from the holster without such specific actions, as these actions could lead to delays in removing the handgun from the holster, and the added moving components, such as straps and/or flaps, are prone to interfere or malfunction after prolonged use. Accordingly, many users prefer passive retention holsters due to the ease of use and durability thereof.

However, because the shape and configuration of handguns varies greatly between manufacturers and even among a single manufacturer's own product lines, holsters are typically offered in many different sizes, shapes and configurations to provide the required fit. Unfortunately, this means that holster manufacturers have to manufacture a relatively large variety of different holsters to provide customers with holsters suitable for specific models of handguns available on the market. This adds to the cost of manufacturing and assembly for the holster manufacturers, and requires sizable inventories of different holster models to be carried by manufacturers and retailers to meet the demand.

A further shortcoming of the passive retention holsters that are available on the market is that different users, and even the same users, prefer to wear their holsters in different positions relative to their bodies, such as at the waist, on the thigh, around an ankle, under an arm or on the chest. This requires a user to have a number of different holsters, depending on the different positions that the user wants the handgun to be secured in relative to his or her body, due to the specific shapes and configurations of most of the retention holsters available on the market.

In addition, due to the fact that passive retention holsters rely primarily if not solely on friction to secure or retain the handgun within the holster, the holster's shape and configuration are relatively fixed to enable a secure fit for a particular handgun. This in turn means that once a user has fastened the holster in a preferred position relative to their body, certain aspects of the handgun's position cannot be adjusted, such as the angle of the holster and/or the position of the grip of the handgun relative to the user's body.

Another shortcoming of passive retention holsters is that these holsters are typically only suited for a specific side of the user's body. More specifically, the hand dominance of a user generally influences and even dictates the hand and manner in which the user would grip the handgun, and thereby on which side of the user's body and the direction in which the holster should preferably be positioned. Therefore, because the shape and configuration of passive retention holsters are relatively fixed, manufacturers of handgun holsters also have to design and manufactured multiple versions of these holsters suited for both right-handed and left-handed users, thereby further increasing the holster designs, manufacturing costs and the size of the inventories that manufacturers and retailers have to offer and carry to meet the demand.

For purposes of this specification, the term "passive retention holster" shall include any holster that relies primarily, with or without the use of additional arrangements, on friction to secure or retain a handgun securely within the holster, and the term "handgun" shall include any derringer, single-shot, revolver, semi-automatic or automatic pistol or other firearm that is generally usable by one hand and carried in a holster on the body of a user.

OBJECT OF THE INVENTION

It is accordingly an object of the invention to provide a novel, versatile, passive retention holster with a plurality of accessories that offers a variety of positional options to its user or at least an alternative holster to the existing arrangements.

SUMMARY OF THE INVENTION

According to a first aspect of the invention there is provided a versatile, passive retention holster comprising a holster body and at least one compatible, interchangeable and adjustable, holster accessory, wherein:

the holster body is provided with a cavity, dimensioned and configured to realisably receive and retain a preselected handgun frictionally therein, the body having:

a first adjustable attachment formation, located on one side of the holster body, wherein the first attachment formation is dimensioned and configured to render the body operatively securable, adjustably, to the compatible holster accessory; and a second adjustable attachment formation, located on an opposing side of the holster body, relative to the first attachment formation, wherein the second attachment formation is dimensioned and configured to render the body operatively securable, adjustably, to the compatible holster accessory; and the compatible holster accessory is provided with a corresponding attachment formation, correspondingly dimensioned and configured to render the compatible holster accessory operatively securable, adjustably and interchangeably, to the opposing sides of the holster body via the first and the second attachment formations;

rendering the holster interchangeably locatable and usable, adjustably, for a left- and a right-handed user on the user's body.

The first and the second attachment formations may comprise a plurality of apertures, configured to receive at least one securing protrusion of a compatible holster accessory. Preferably, the first and the second attachment formations may comprise of at least one circular aperture and at least one angled slit, wherein both the aperture and the slit are dimensioned and configured to receive at least one securing protrusion of a compatible holster accessory slidably adjustable, between a plurality of orientations, enabling the position of the holster body to be slidably adjustable and securable relative to the compatible accessory. More preferably, the first and the second attachment formations comprise at least one circular aperture and at least one kidney-shaped slit, rendering the position of the holster body slidably adjustable and securable, both in a plane parallel to, rotatably around an axis with, and angularly, transversely relative to the compatible accessory.

The cavity of the holster body may be contoured to fit closely with the exterior profile of a preselected handgun. Preferably, the cavity may be contoured to receive a preselected handgun snugly, frictionally therein, thereby enabling the holster body to provide frictional resistance against the insertion and removal of the handgun from the holster body.

The holster body may comprise three adjacent walls, contoured to fit closely around the exterior profile of a preselected handgun, the walls defining a top wall, a first and a second, opposing side wall, collectively providing a longitudinal channel with an open rear and an opposing, open front end, with the side walls terminating oppositely the top wall in a longitudinal slot, extending at least partially between the two opposing ends, the slot defining the bottom of the holster body.

The first and the second side walls may terminate in corresponding, opposed first and second flanges, extending at least partially along the longitudinal slot. Preferably, the opposed first and second flanges extend substantially along the longitudinal slot.

The first and the second flanges may be provided with corresponding, adjustable attachment formations, dimensioned and configured to secure the opposed flanges at a preselected, adjustable distance to each other. Preferably, the adjustable attachment formations are dimensioned and configured to adjust the distance between the secured flanges, and thereby the circumference of the holster body, to a preselected level, thereby adjusting the frictional resistance of the holster body against the insertion and removal of the handgun from the holster body.

The holster body may comprise a relatively thin-walled, single sheet of resiliently flexible, material, sufficiently rigid and suitably dimensioned and configured to define the three adjacent walls, with the top wall, the first and the second, opposing side wall integrally linked to provide collectively the longitudinal channel with the open rear and the opposing, open front end, with the side walls terminating oppositely the top wall in the longitudinal slot. Preferably, the material is selected from a group including plastic polymers, metal alloys and the like.

The compatible holster accessory may be selected from the group comprising an interchangeable, adjustable belt clip, waistband clip, belt spacer assembly and cover plate, rendering the compatible holster accessory operatively securable, adjustably and interchangeably, to the opposing sides of the holster body via the first and the second attachment formations, and hence the holster interchangeably locatable and usable, adjustably, for a left- and a right-handed user on the user's body.

According to a second aspect of the invention there is provided kit for a versatile, passive retention holster, the kit including a holster body and at least one compatible, interchangeable and adjustable holster accessory, wherein:

the holster body is provided with a cavity, dimensioned and configured to realisably receive and retain a preselected handgun frictionally therein, the body having:

a first adjustable attachment formation, located on one side of the holster body, wherein the first attachment formation is dimensioned and configured to render the body operatively securable, adjustably, to the compatible holster accessory; and a second adjustable attachment formation, located on an opposing side of the holster body, relative to the first attachment formation, wherein the second attachment formation is dimensioned and configured to render the body operatively securable, adjustably, to the compatible holster accessory; and the compatible holster accessory is provided with a corresponding attachment formation, correspondingly dimensioned and configured to render the compatible holster accessory operatively securable, adjustably and interchangeably, to the opposing sides of the holster body via the first and the second attachment formations;

rendering the holster interchangeably locatable and usable, adjustably, for a left- and a right-handed user on the user's body.

The holster body and the compatible holster accessory may be substantially as hereinbefore defined.

DETAILED DESCRIPTION OF THE INVENTION

A non-limiting embodiment of the invention shall now be described with referenced to the accompanying drawings wherein.

Figure 1:
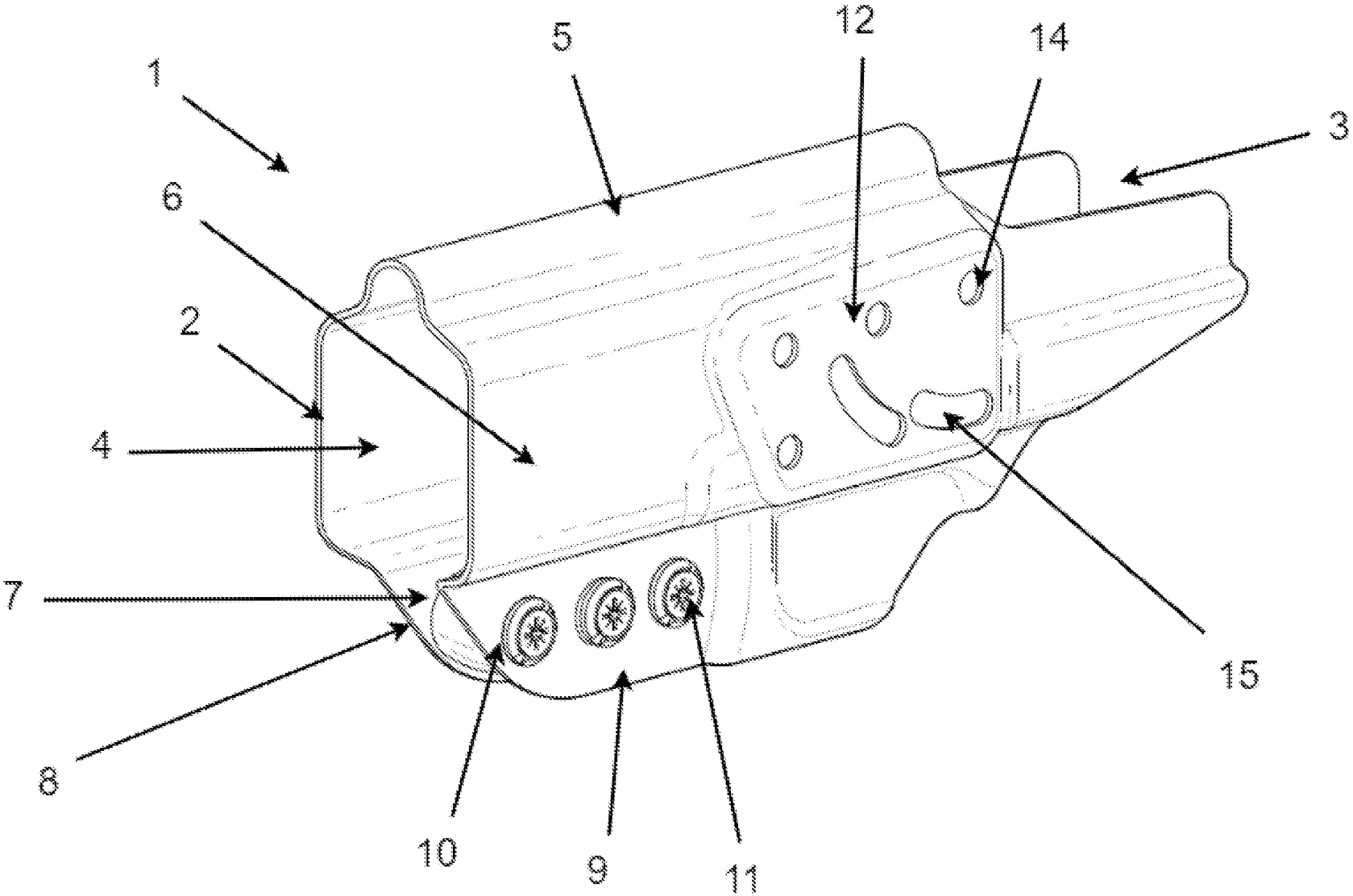
FIG. 1 is a front-perspective view of a modular adjustable handgun holster in accordance with the invention.
Figure 2:
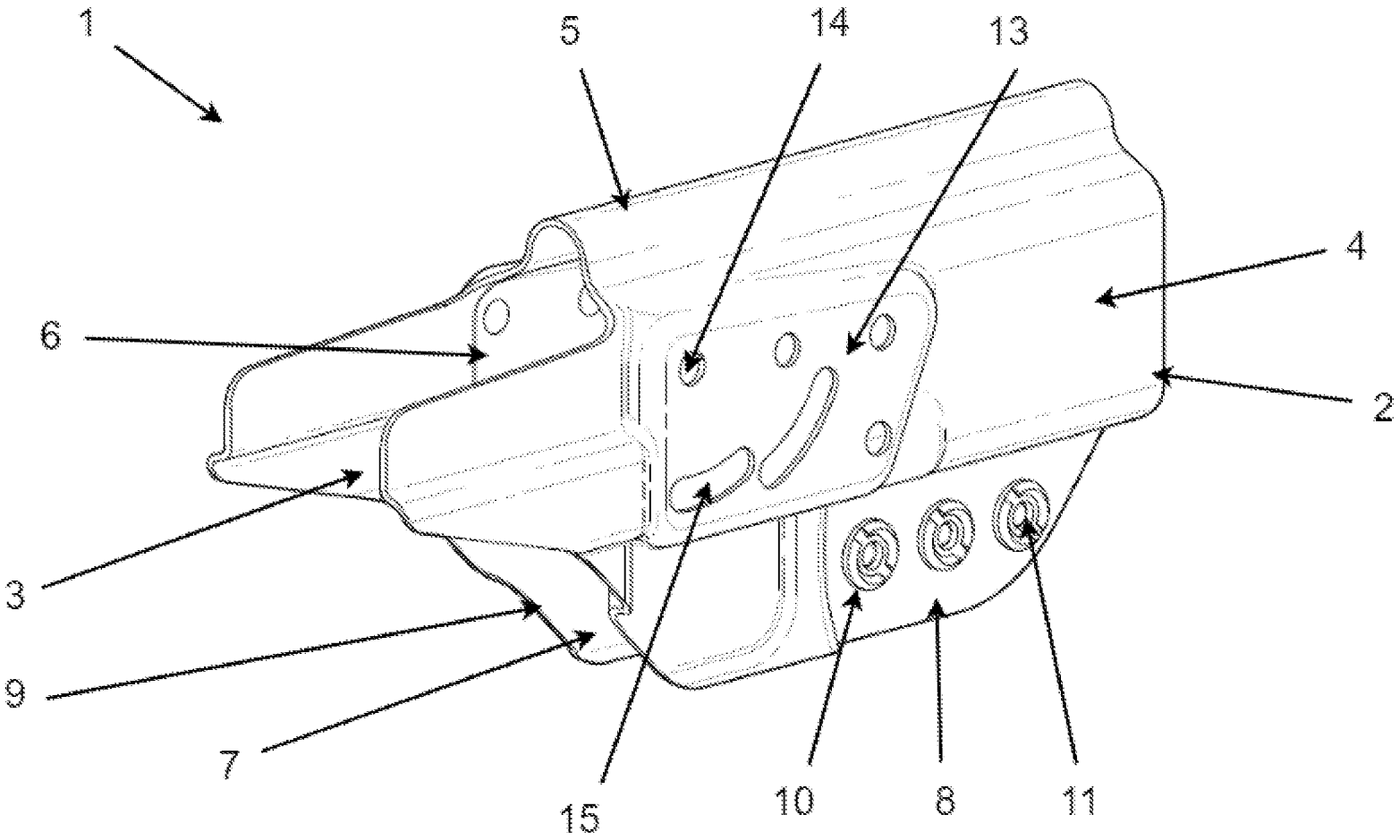
FIG. 2 is a rear-perspective view of the modular adjustable handgun holster, as illustrated in FIG. 1.
Figure 3:
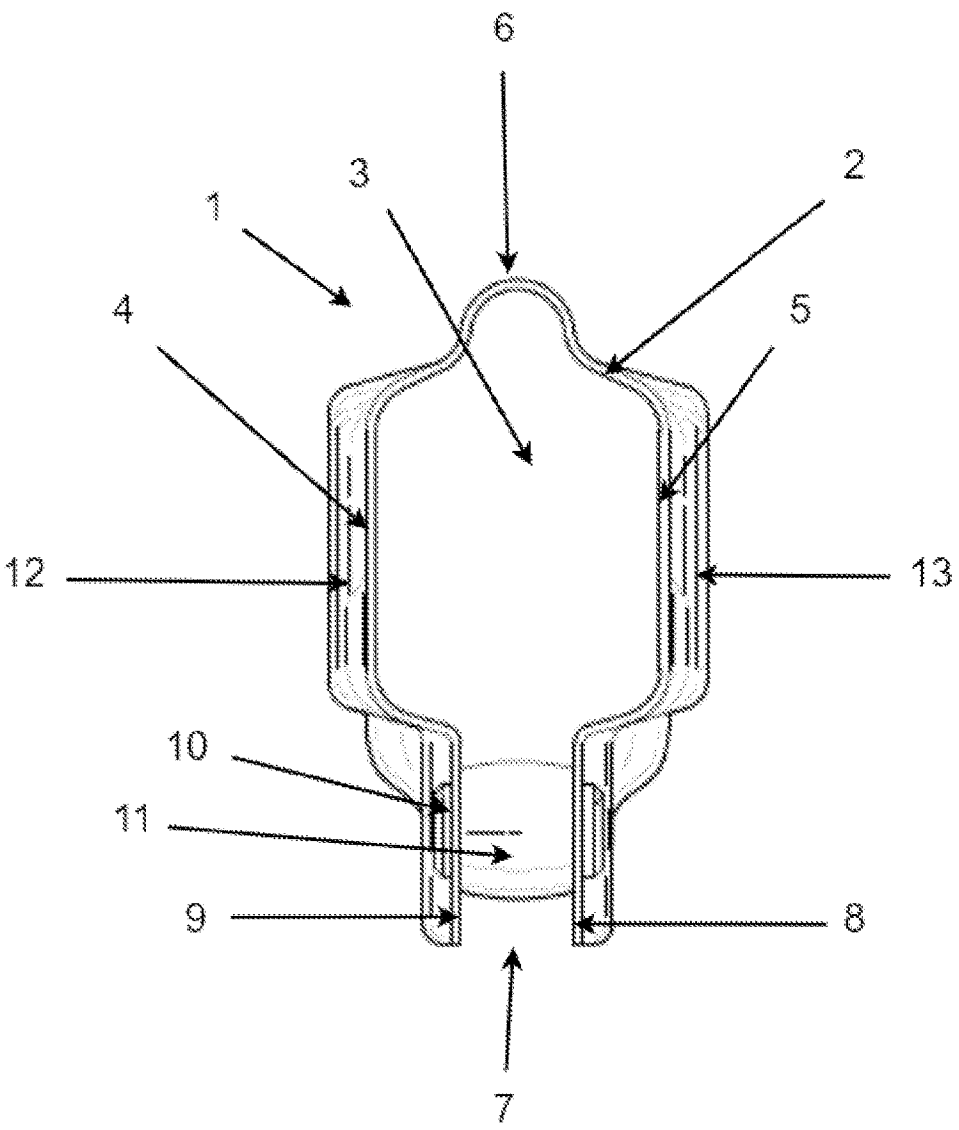
FIG. 3 is a front view of the modular adjustable handgun holster, as illustrated in FIG. 1.
Figure 4:
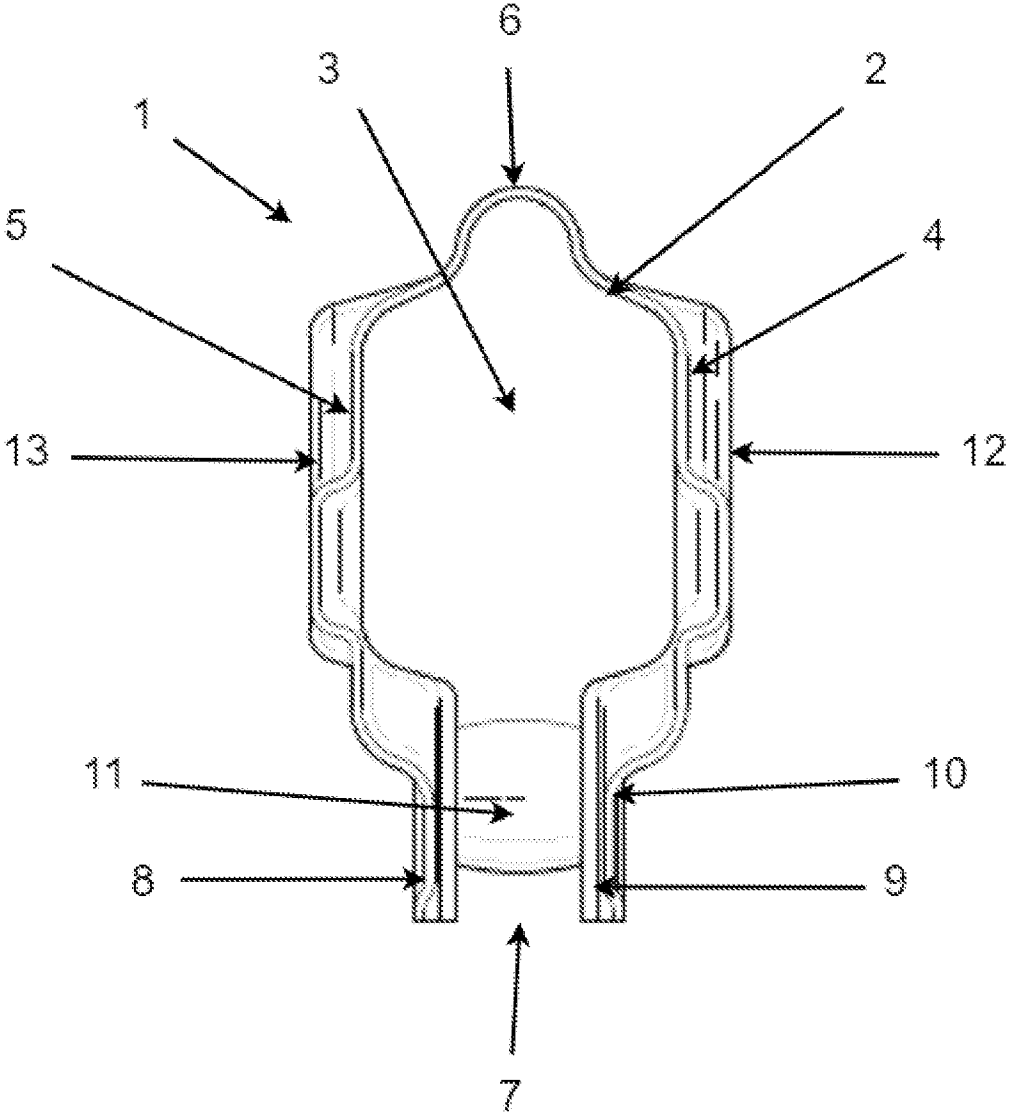
FIG. 4 is a rear view of the modular adjustable handgun holster, as illustrated in FIG. 1.
Figure 5:
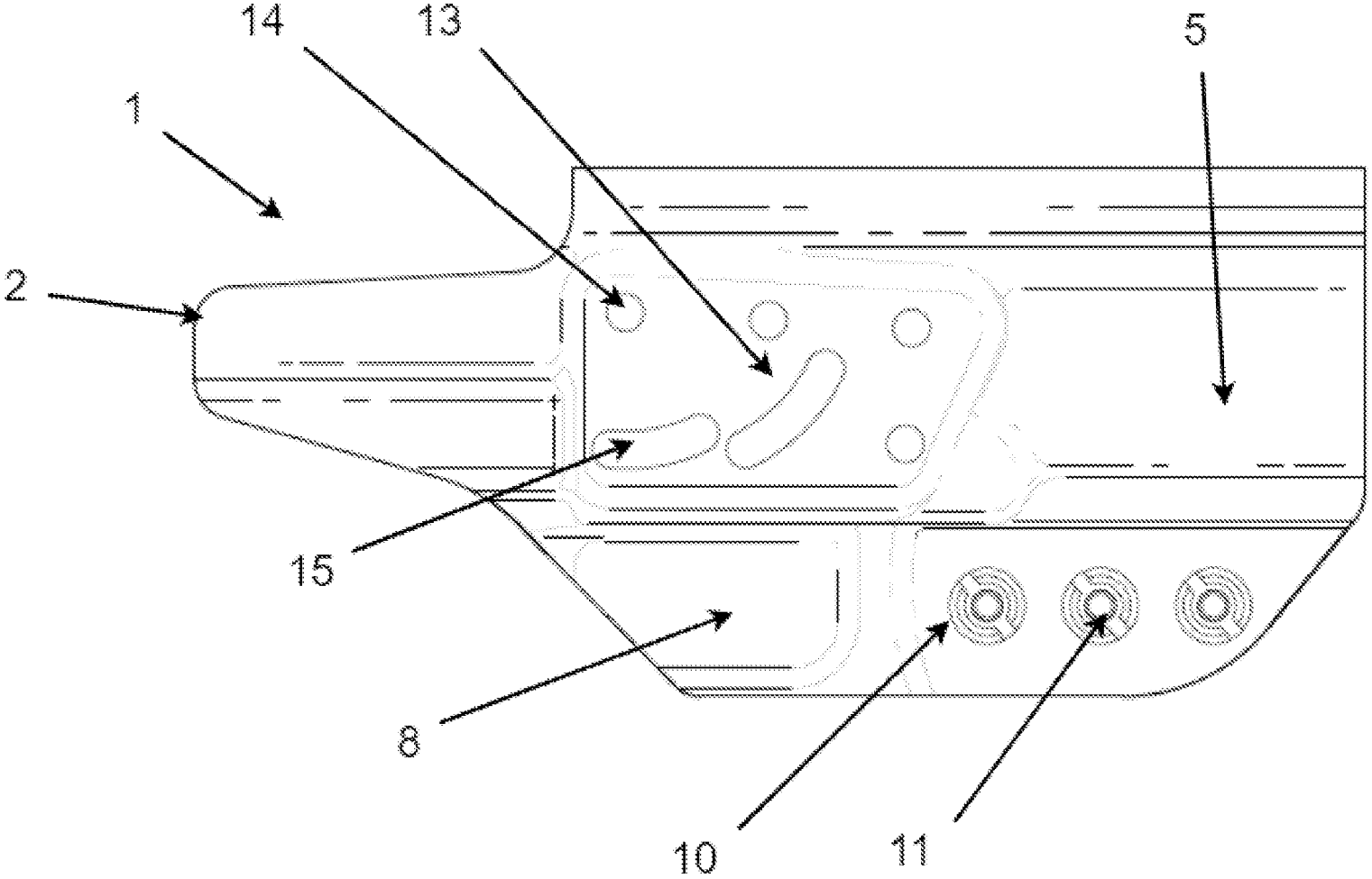
FIG. 5 is a right-side view of the modular adjustable handgun holster, as illustrated in FIG. 1.
Figure 6:
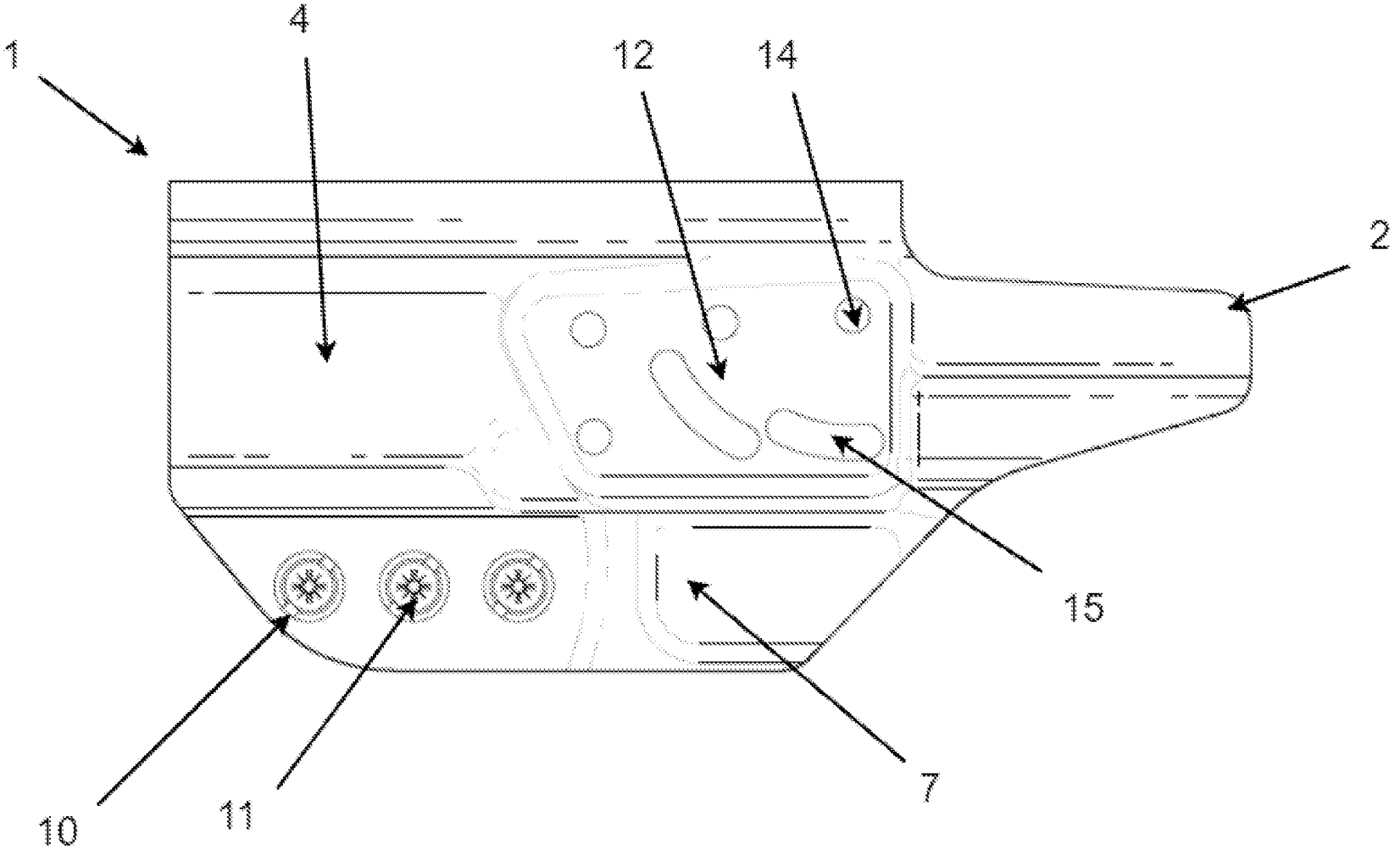
FIG. 6 is a left-side view of the modular adjustable handgun holster, as illustrated in FIG. 1.
Figure 7:
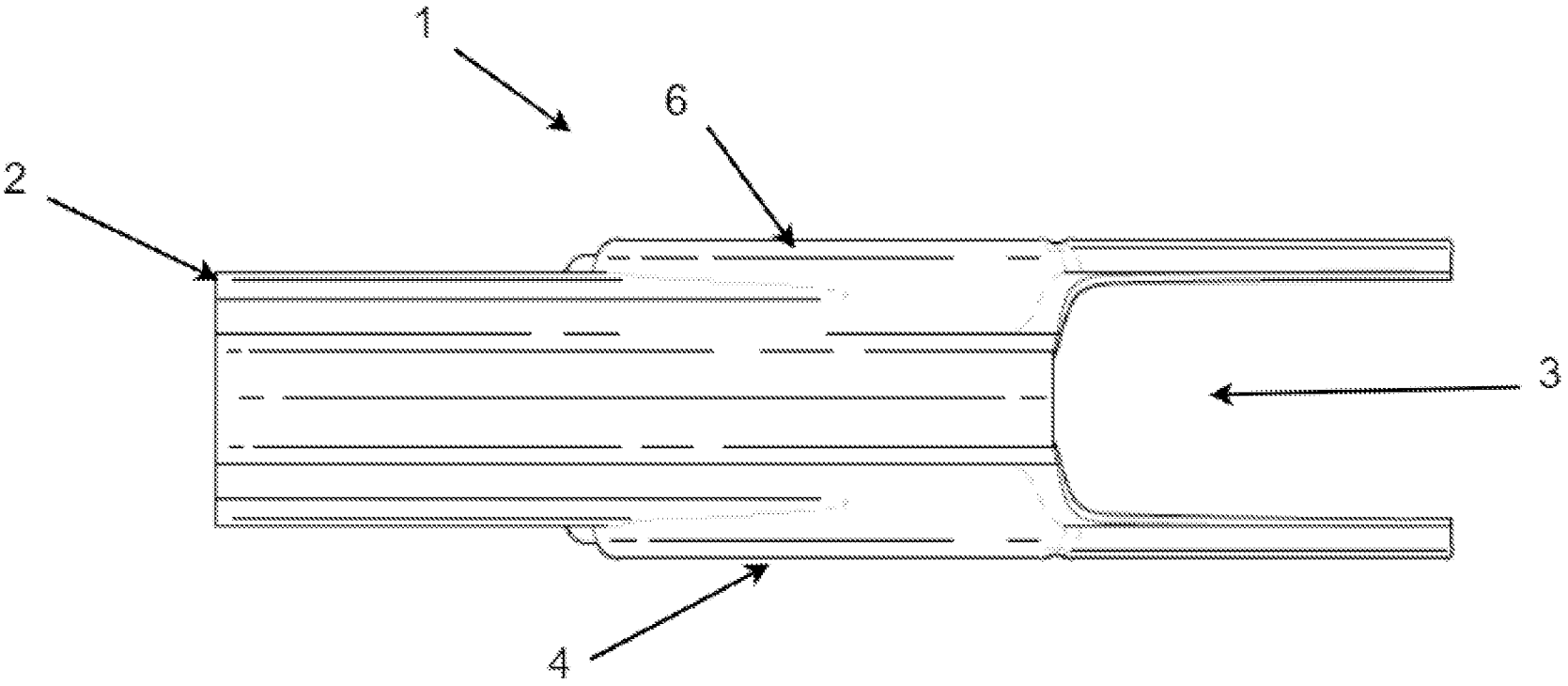
FIG. 7 is a top view of the modular adjustable handgun holster, as illustrated in FIG. 1.
Figure 8:
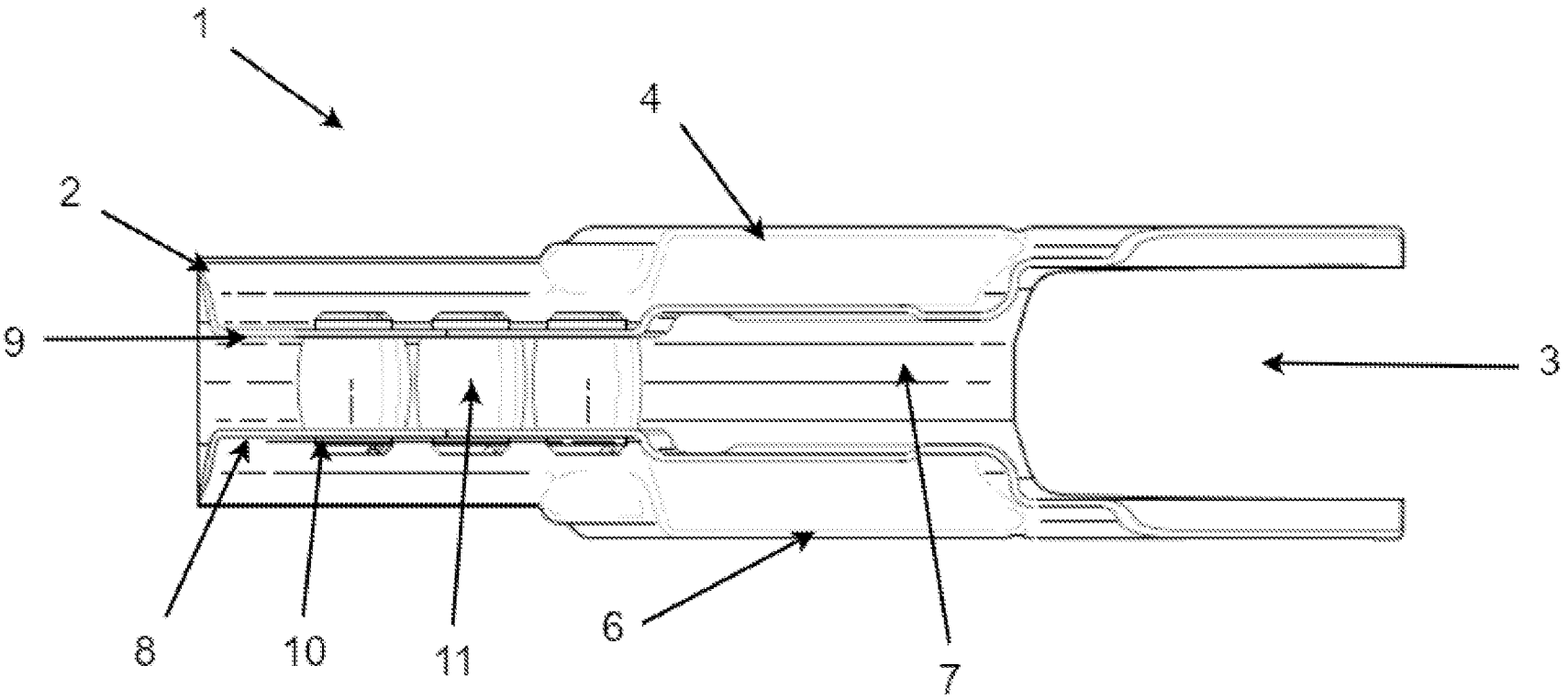
FIG. 8 is a bottom view of the modular adjustable handgun holster, as illustrated in FIG. 1.

A modular adjustable handgun holster 1 as illustrated in FIGS. 1 to 8 comprises a holster body 2 defining a cavity 3 configured to realisably receive a preselected handgun (not shown) therein. The holster body 2 is contoured to closely fit the exterior profile of the preselected handgun (not shown), allowing the compatible handgun to fit snugly within the holster body, thereby providing frictional resistance against the insertion and removal of the handgun from the holster body.

The holster body 2 comprises a first side wall 4, a curved top wall 5 and a second, opposed side wall 6 defining the cavity 3. The cavity 3 is in the form of a longitudinal channel. The first and the second side walls 4, 6 terminate at the bottom part of the holster body 2, defining a longitudinal slot or opening 7 across the length of the holster body. The first and the second side walls 4, 6 terminate in opposed flanges 8, 9 that extend laterally from the first and the second side walls towards the longitudinal slot 7, extending across the length of the holster body 2.

Each of the flanges 8, 9 is provided with three equi-spaced circular holes 10, configured to be connectable to a spacer assembly 11. The spacer assembly 11 comprises of at least one spacer, configured to be positioned across the longitudinal opening 7 between the flanges 8, 9, and attached to at least one of the holes 10. The spacer assembly 11 is configured to allow the distance between the flanges 8, 9 to be adjusted, thereby adjusting the width of the longitudinal opening 7. The adjustment of the width of the longitudinal opening 7 allows the size of the cavity 3 to be adjusted, thereby causing the frictional resistance of the holster body 3 against the insertion and removal of the handgun from the holster body to be adjusted.

The first and the second side walls 4, 6 are each further provided with attachment formations 12, 13 that are each configured to be connectable to at least one compatible holster accessory. Each of the attachment formations comprises a plurality of circular holes 14, and a plurality of angled slits 15. The angled slits 15 are primarily kidney shaped. The attachment formations 12, 13 are configured to receive the locking protrusions of compatible holster accessories. The angled slits 15 are configured to allow at least one of the locking protrusions of a compatible holster accessories to be attached in a plurality of positions relative to the locking protrusion that is attached to one of the circular holes 14. This allows the position of the holster body to be adjusted relative to the holster accessory. Furthermore, and due to each of the first and the second side walls 4, 6 being provided with respective attachment formations 12, 13, compatible holster accessories can be attached on either side of the holster body, depending on the preferences of the user.

Figure 9:
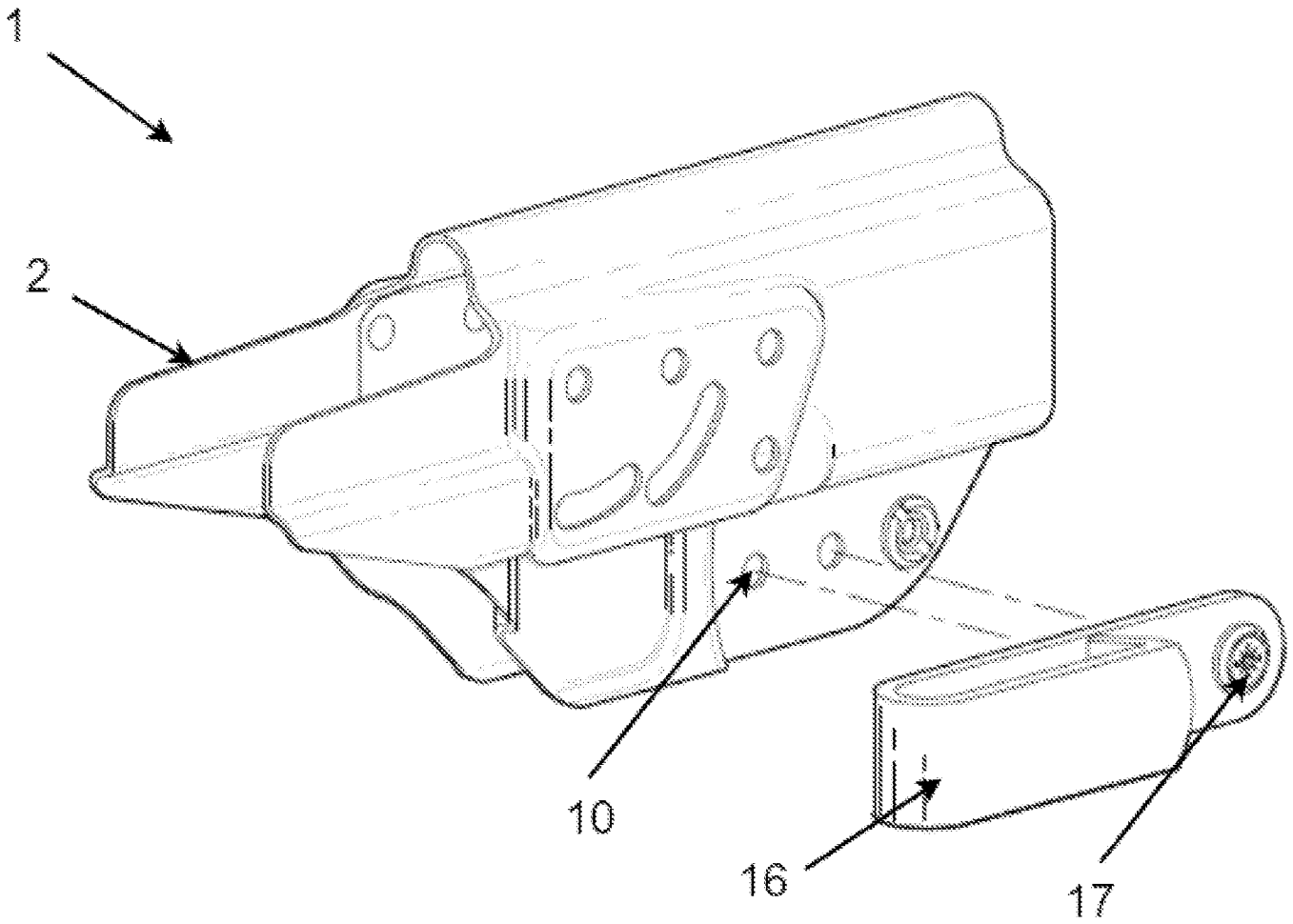
FIG. 9 is an exploded, rear-perspective view of the modular adjustable handgun holster, as illustrated in FIG. 1, indicating how a compatible accessory is attached thereto.
Figure 10:
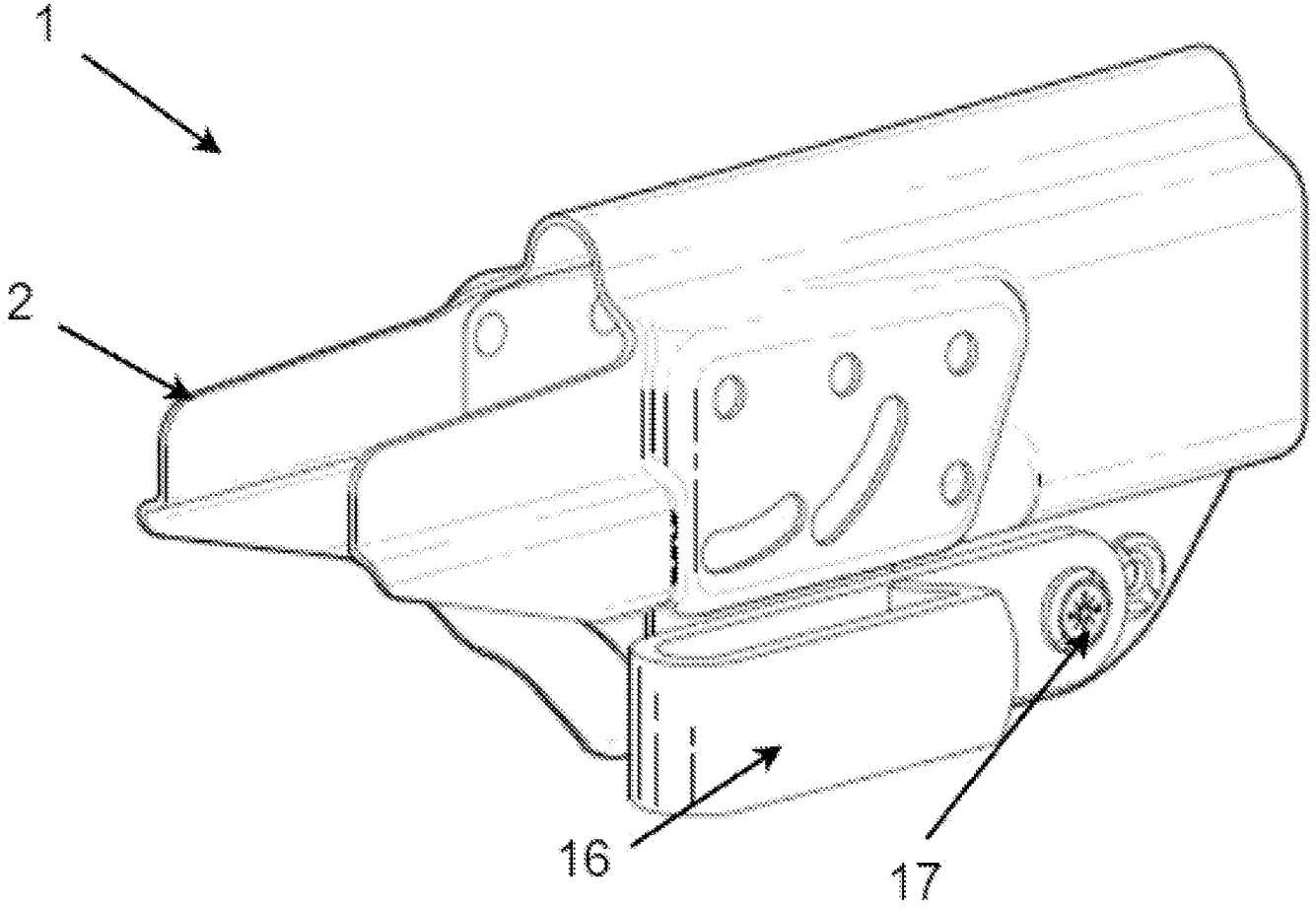
FIG. 10 is a rear-perspective view of the modular adjustable handgun holster, as illustrated in FIG. 1, with a compatible accessory attached thereto.

As indicated in FIGS. 9 and 10, a belt clip 16 can be attached to the holster body 2, by attaching at least one of its locking protrusions 17 to at least one of the equi-spaced circular holes 10.

Figure 11:
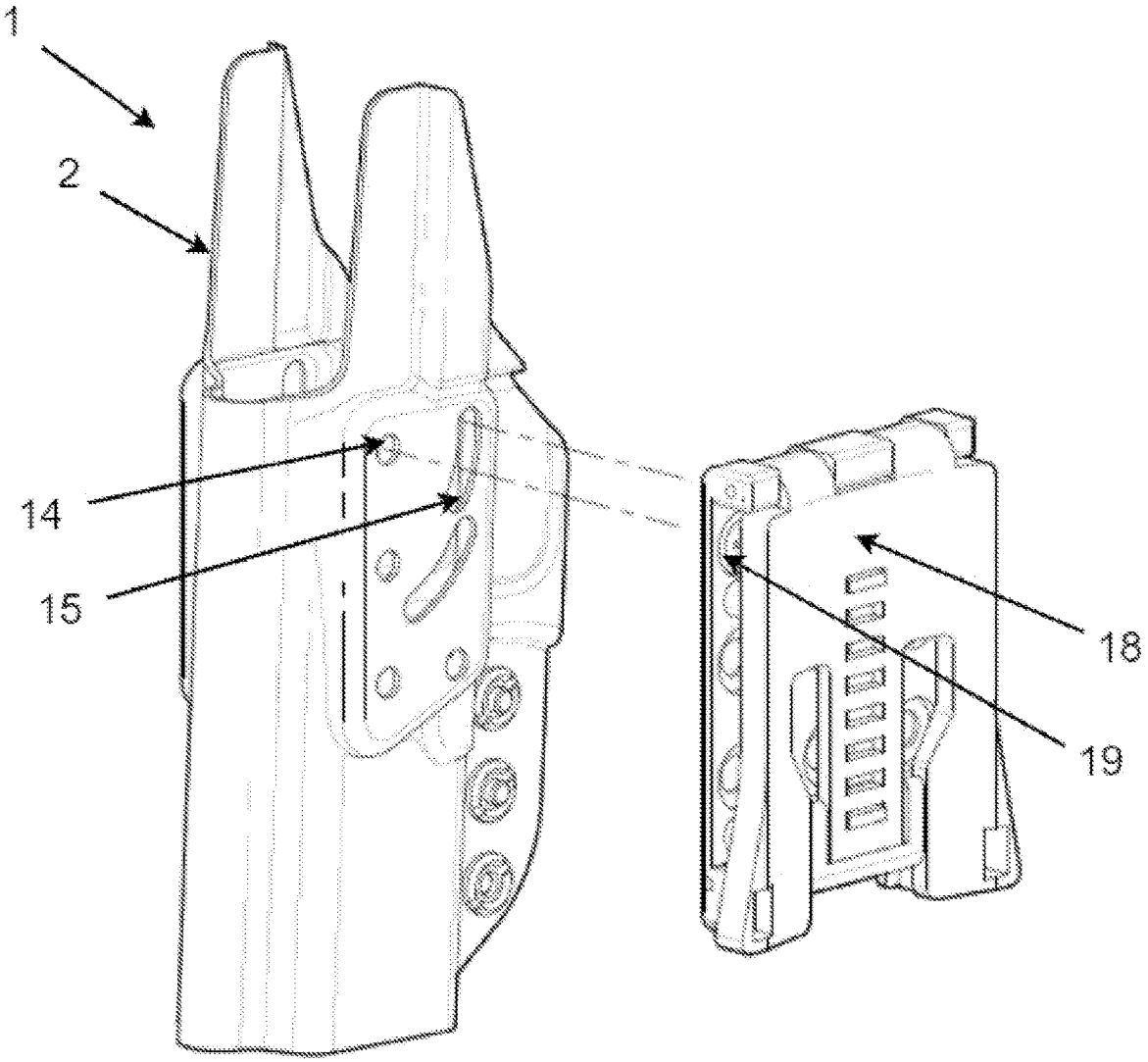
FIG. 11 is an exploded, rear-perspective view of the modular adjustable handgun holster, as illustrated in FIG. 1, indicating how an alternative compatible accessory is attached thereto.
Figure 12:
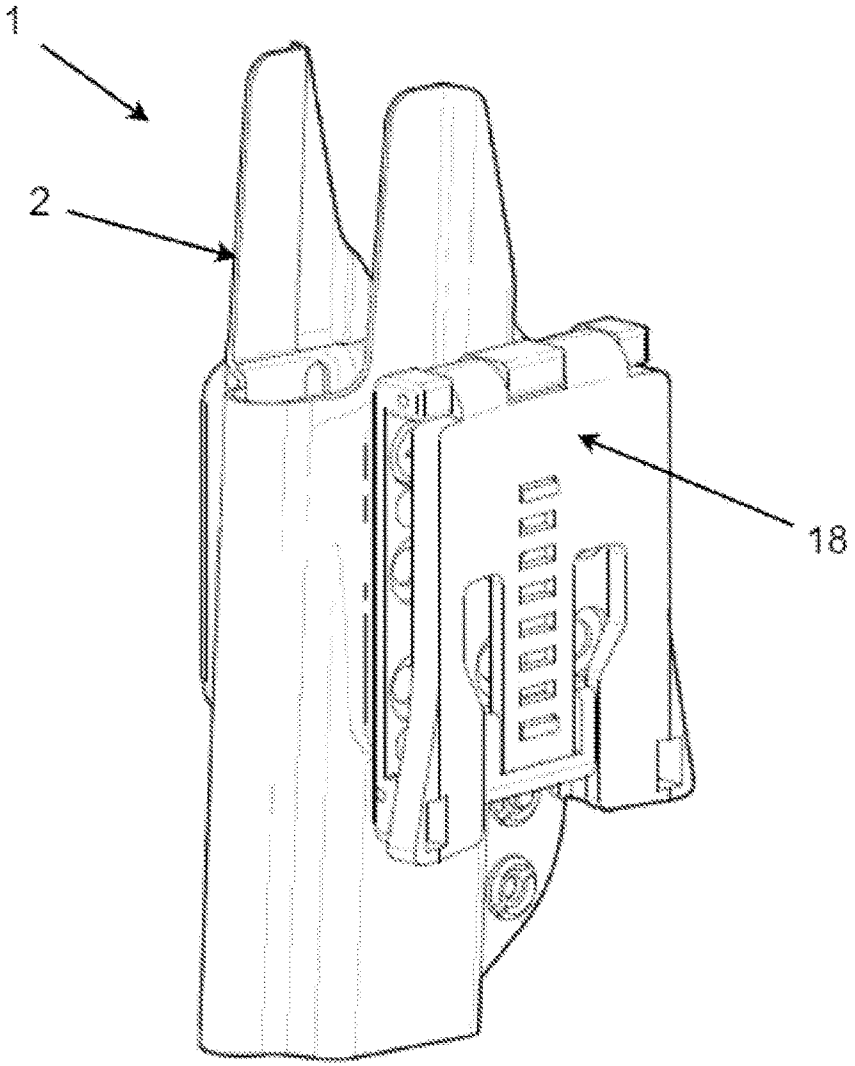
FIG. 12 is a rear-perspective view of the modular adjustable handgun holster, as illustrated in FIG. 1, with an alternative compatible accessory attached thereto.

As indicated in FIGS. 11 and 12, an adjustable belt clip 18 can be attached to the holster body 2, by attaching at its locking protrusions 19 to at least one of the circular holes 14, and at least one of the angled slits 15 of either the attachment formations 12, 13.

Figure 13:
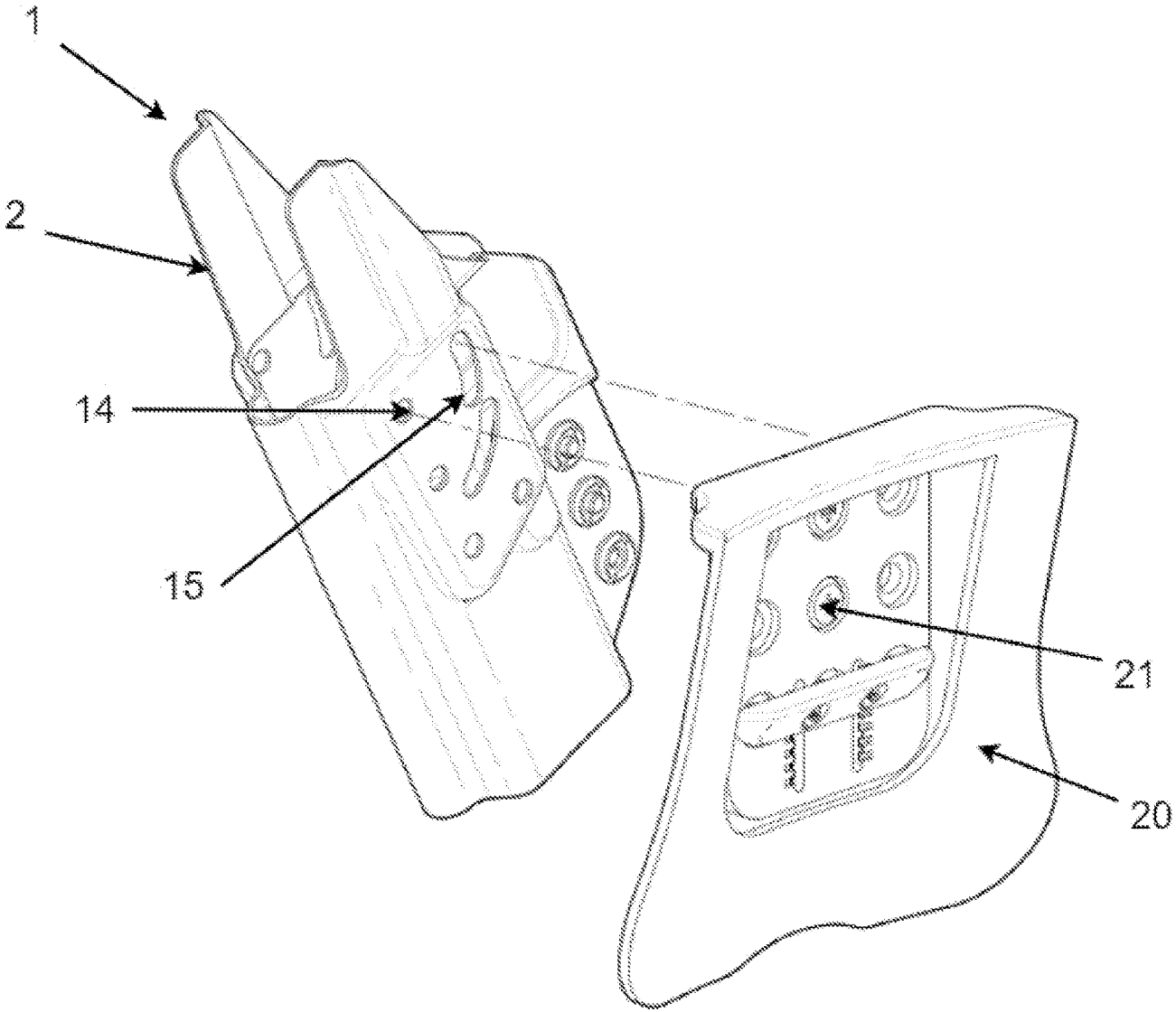
FIG. 13 is an exploded, rear-perspective view of the modular adjustable handgun holster, as illustrated in FIG. 1, indicating how a further alternative compatible accessory is attached thereto.
Figure 14:
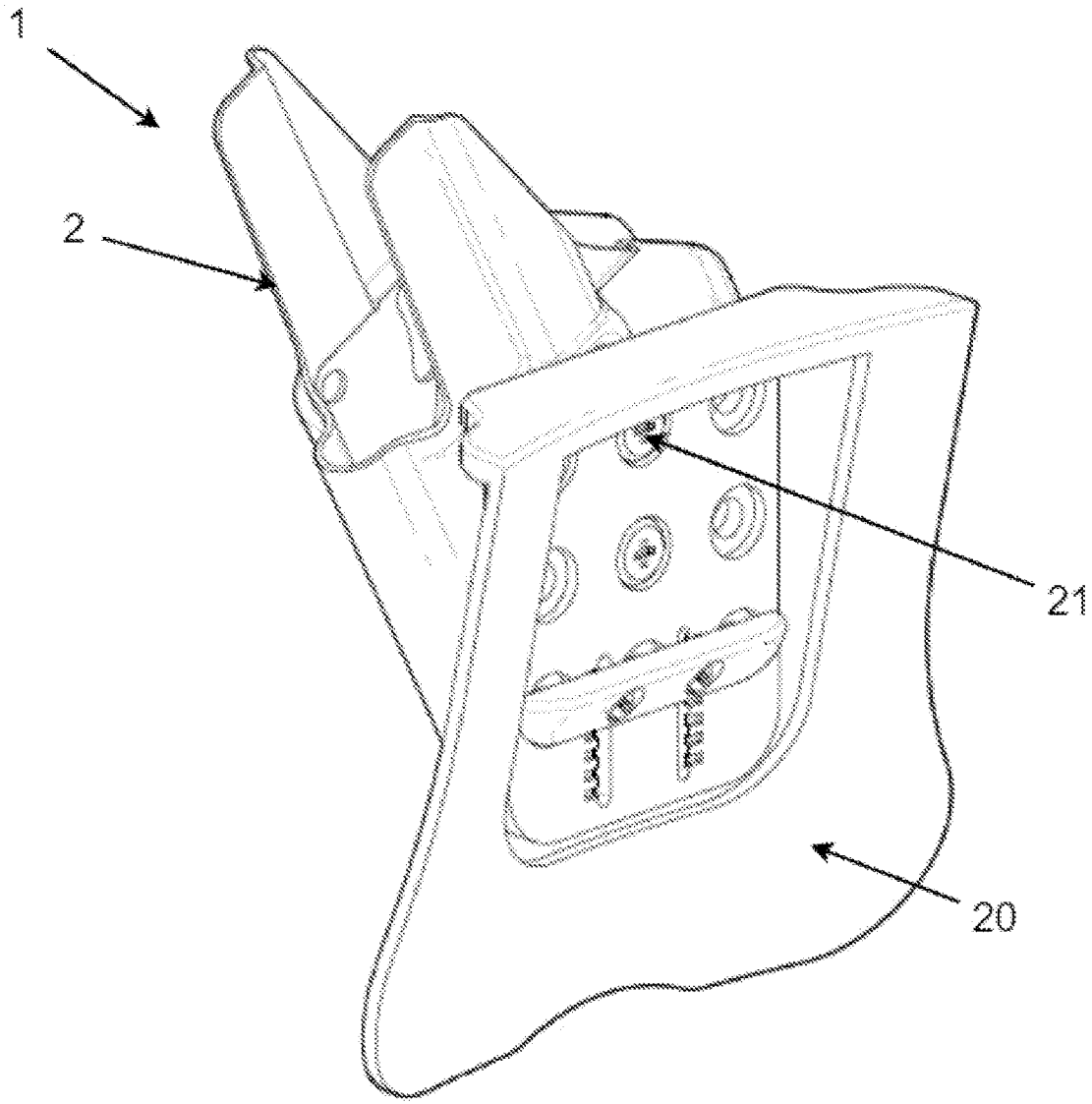
FIG. 14 is a rear-perspective view of the modular adjustable handgun holster, as illustrated in FIG. 1, with a further alternative compatible accessory attached thereto.

As indicated in FIGS. 13 and 14, an adjustable waistband clip 20 can be attached to the holster body 2, by attaching its locking protrusions 21 to at least one of the circular holes 14, and at least one of the angled slits 15 of either of the attachment formations 12, 13.

Figure 15:
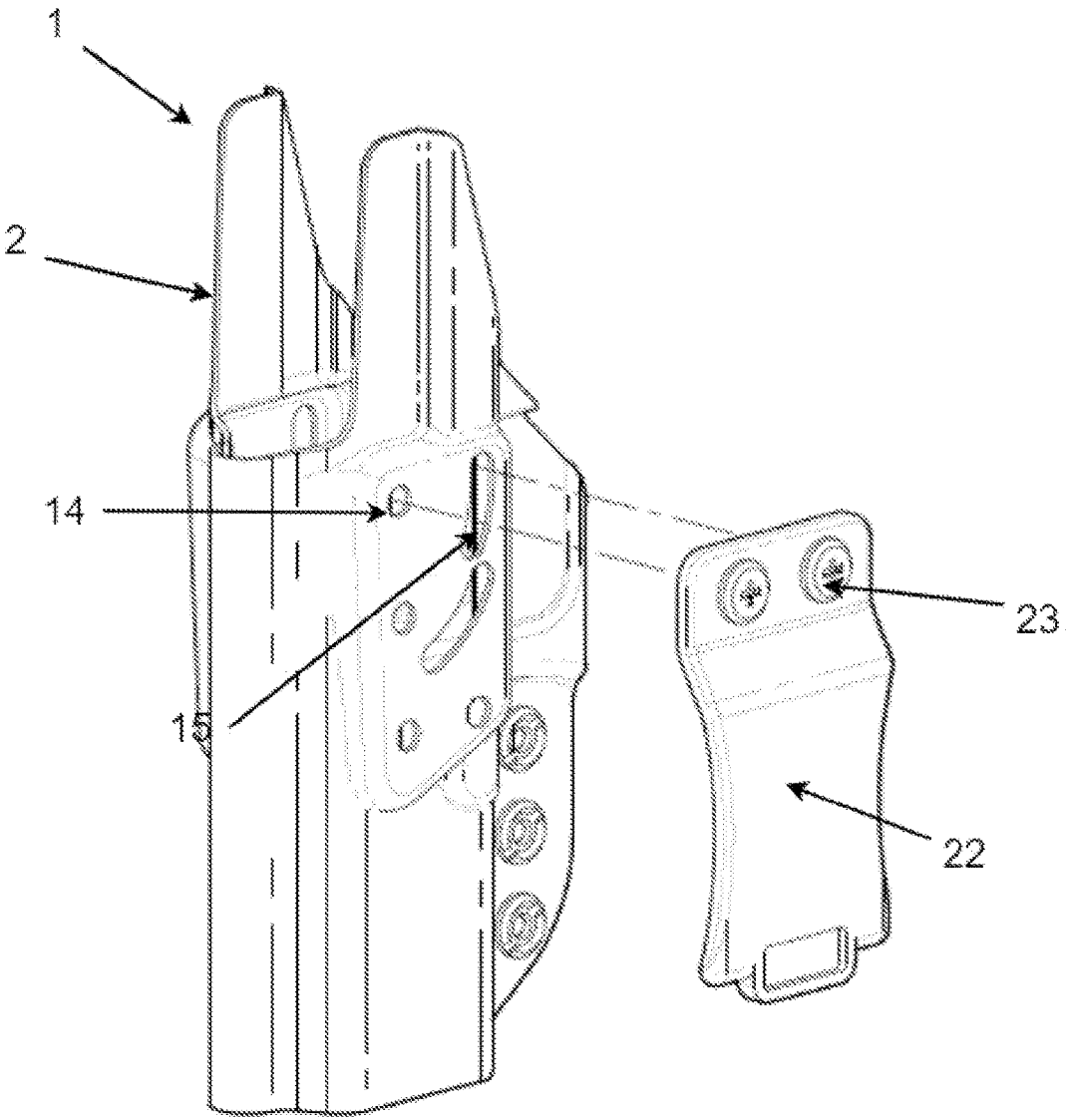
FIG. 15 is an exploded, rear-perspective view of the modular adjustable handgun holster, as illustrated in FIG. 1, indicating how a further alternative compatible accessory is attached thereto.
Figure 16:
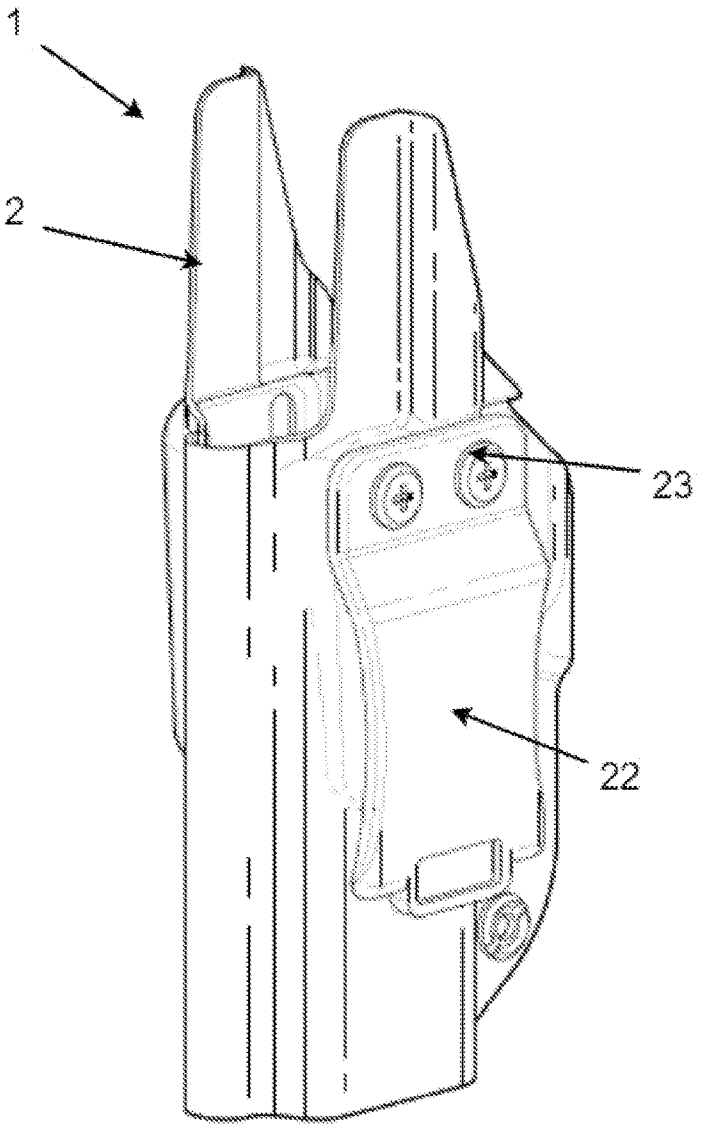
FIG. 16 is a rear-perspective view of the modular adjustable handgun holster, as illustrated in FIG. 1, with a further alternative compatible accessory attached thereto.

As indicated in FIGS. 15 and 16, an adjustable belt clip 22 can be attached to the holster body 2, by attaching its locking protrusions 23 to at least one of the circular holes 14, and at least one of the angled slits 15 of either of the attachment formations 12, 13.

Figure 17:
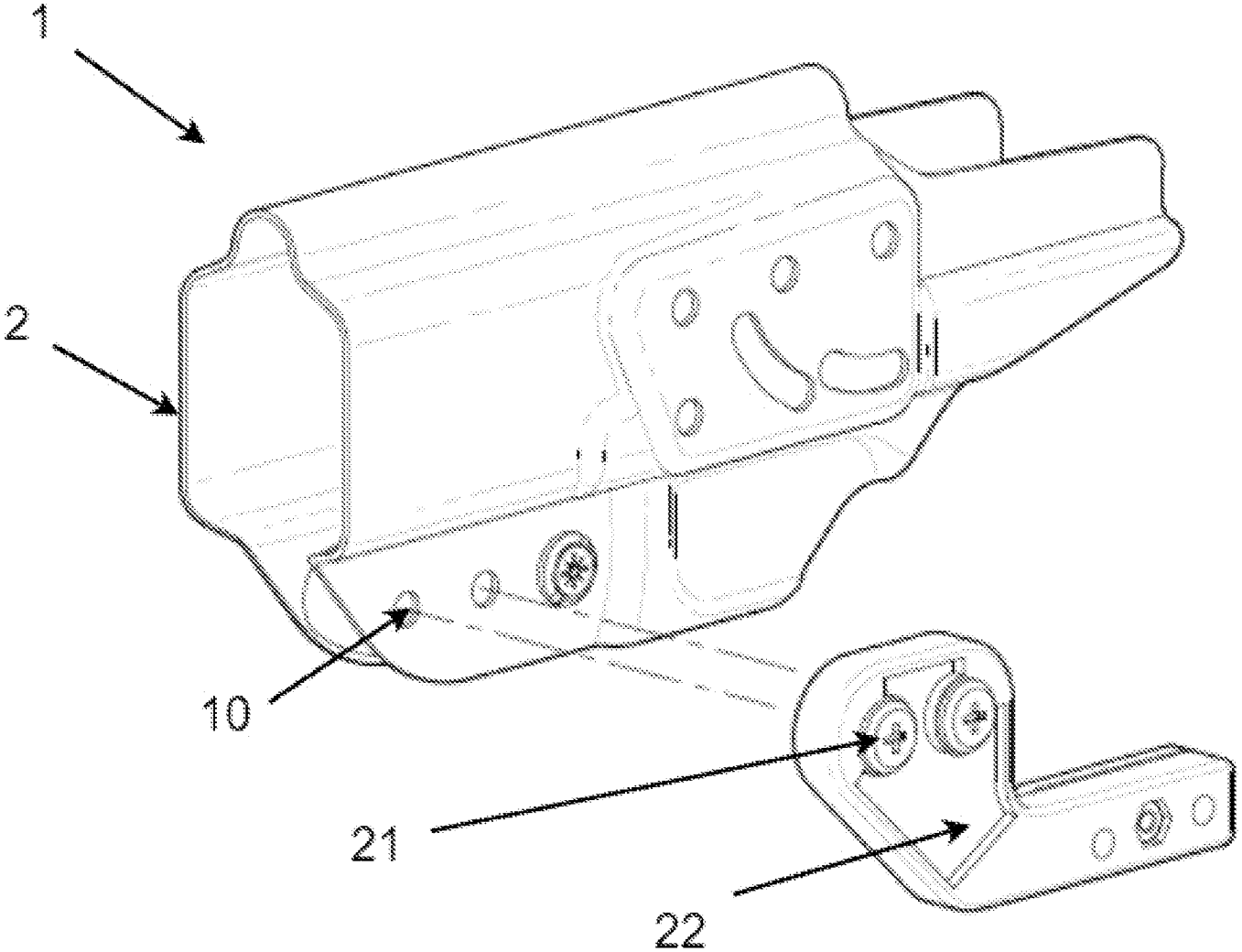
FIG. 17 is an exploded, rear-perspective view of the modular adjustable handgun holster, as illustrated in FIG. 1, indicating how a further alternative compatible accessory is attached thereto.
Figure 18:
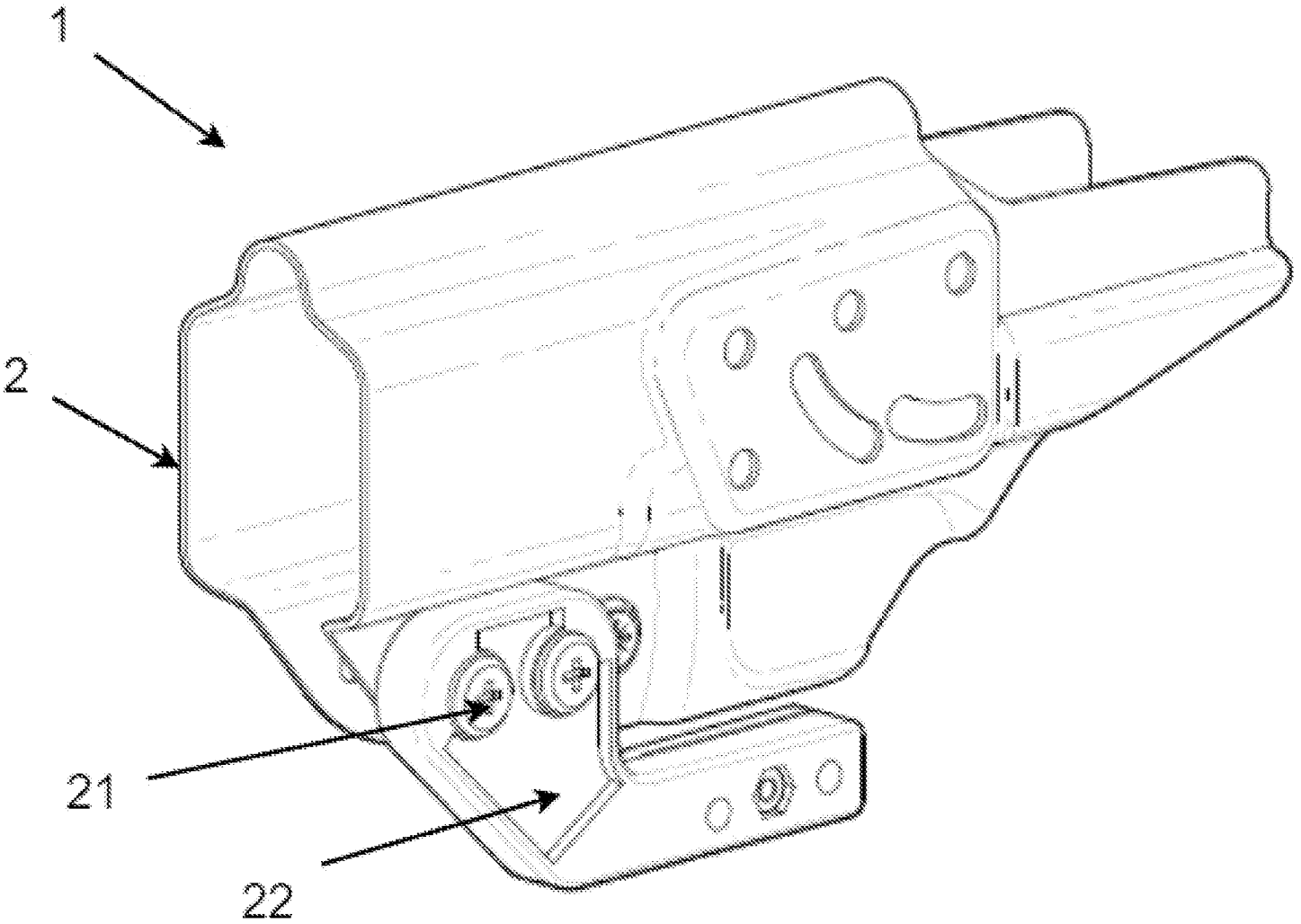
FIG. 18 is a rear-perspective view of the modular adjustable handgun holster, as illustrated in FIG. 1, with a further alternative compatible accessory attached thereto.

As indicated in FIGS. 17 and 18, a belt spacer assembly 24 can be attached to the holster body 2, by attaching at least one of its locking protrusions 25 to at least one of the equi-spaced circular holes 10.

Figure 19:
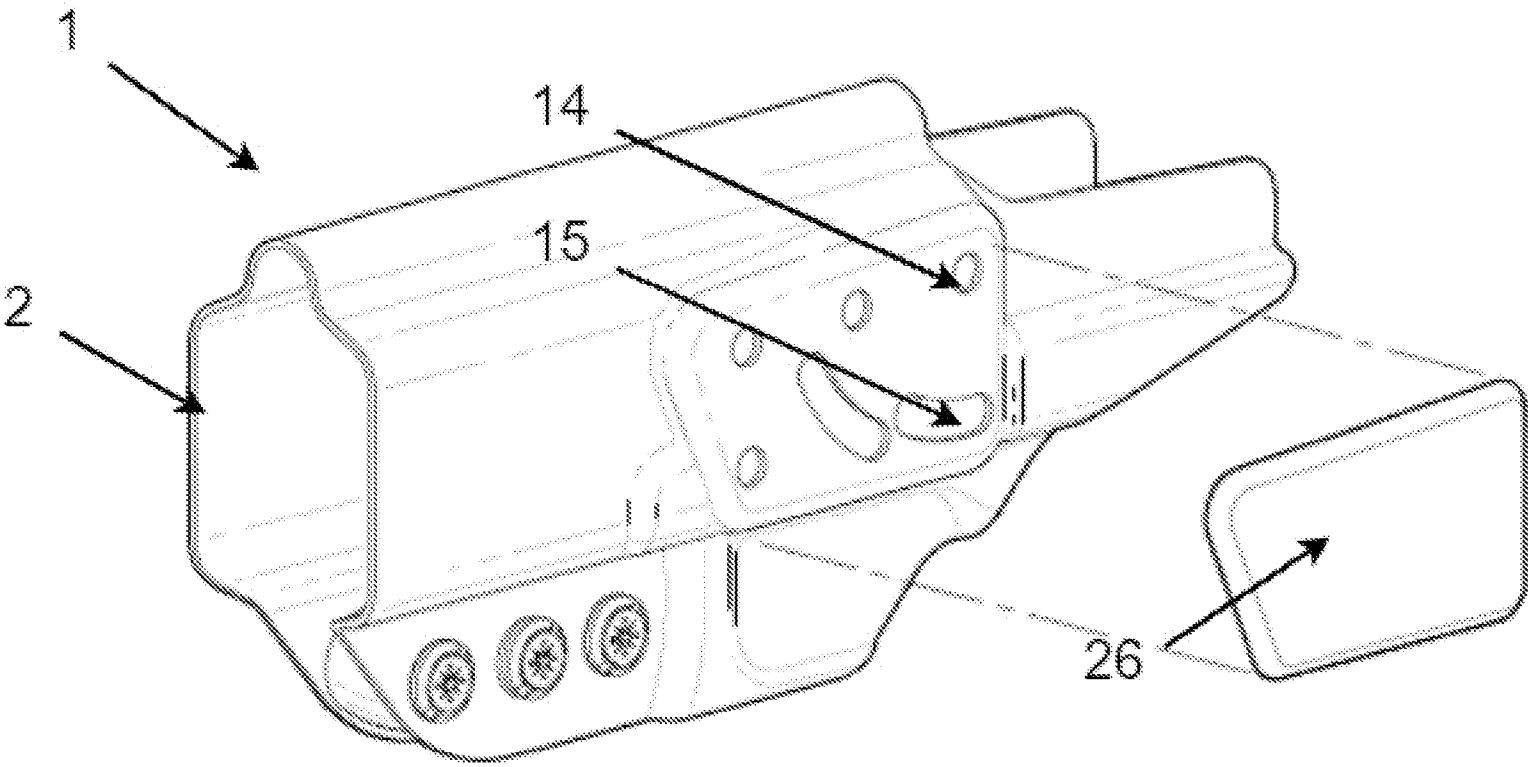
FIG. 19 is an exploded, rear-perspective view of the modular adjustable handgun holster, as illustrated in FIG. 1, indicating how a further alternative compatible accessory is attached thereto.
Figure 20:
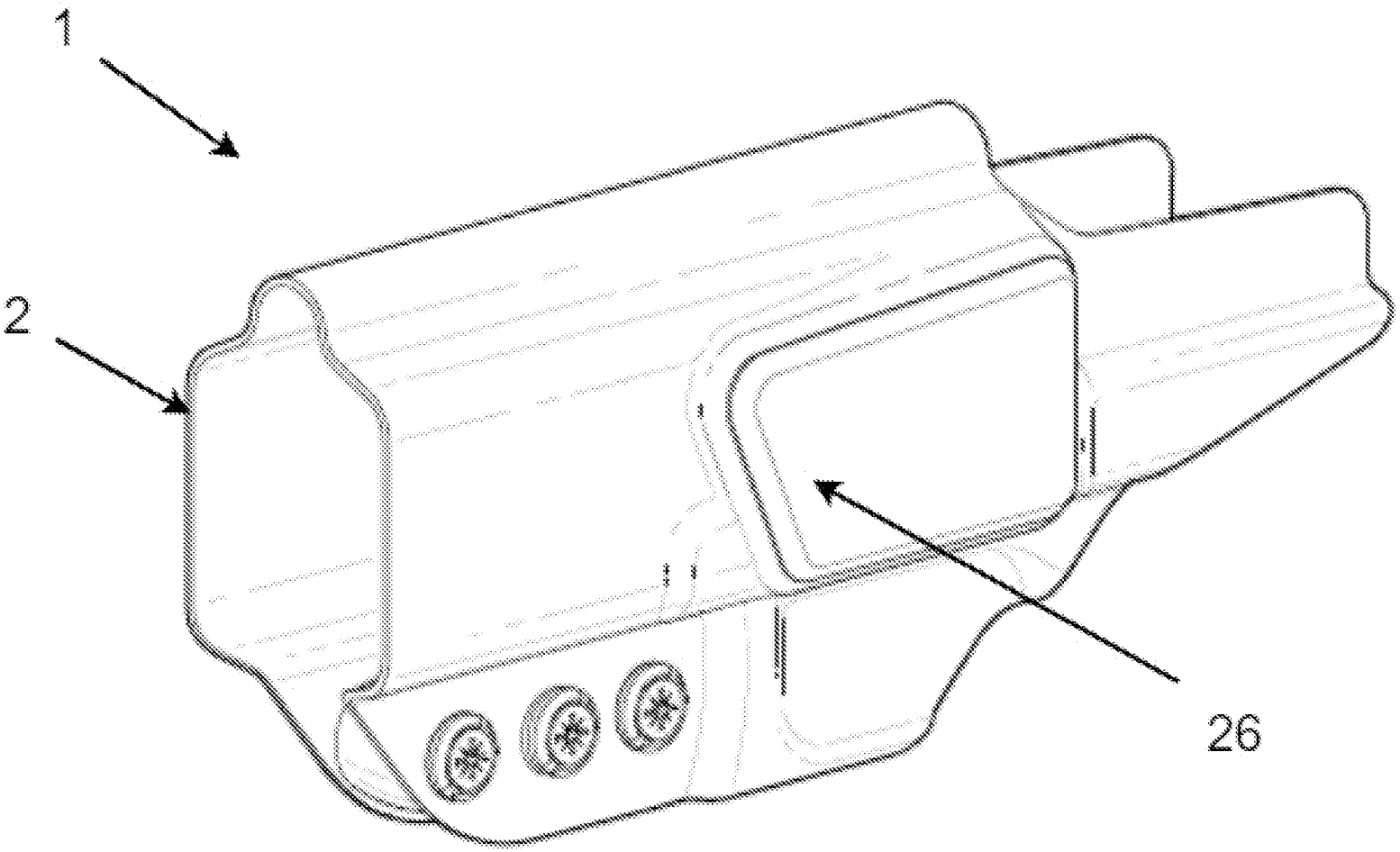
FIG. 20 is a rear-perspective view of the modular adjustable handgun holster, as illustrated in FIG. 1, with a further alternative compatible accessory attached thereto.

As indicated by FIGS. 19 and 20, a cover plate 26 can be attached to the holster body 2, by attaching its locking protrusions (not shown) to at least one of the circular holes 14, and/or at least one of the angled slits 15 of either of the attachment formations 12, 13

It will be appreciated that many variations in detail are possible without departing from the scope and/or spirit of the inventions as defined in the consistory statements and/or as described in the specific embodiment hereinabove, such as offering additional, compatible holster accessories that are operatively securable, adjustably and interchangeably, to the opposing sides of the holster body via the first and the second attachment formations, to render the holster interchangeably locatable and usable, adjustably, for a left- and a right-handed user on the user's body.

The invention claimed is:

1. A versatile, passive retention holster comprising a holster body and at least one compatible, interchangeable and adjustable, holster accessory, wherein the holster body comprises a cavity, dimensioned and configured to releasably receive and retain a preselected handgun frictionally therein, and, wherein the holster body further comprises a first adjustable attachment formation, located on one side of the holster body, wherein the first adjustable attachment formation is dimensioned and configured to render the holster body operatively securable, adjustably to the at least one compatible, interchangeable, and adjustable holster accessory; and a second adjustable attachment formation, located on an opposing side of the holster body, relative to the first adjustable attachment formation, wherein the second adjustable attachment formation is dimensioned and configured to render the holster body operatively securable, adjustably to the at least one compatible, interchangeable, and adjustable holster accessory;

wherein the at least one compatible, interchangeable, and adjustable holster accessory comprises a corresponding attachment formation, correspondingly dimensioned and configured to render the at least one compatible, interchangeable, and adjustable holster accessory operatively securable, adjustably and interchangeably, to the opposing sides of the holster body via the first and the second adjustable attachment formations; and wherein the first and the second attachment formations comprise at least one aperture and at least one angled slit, wherein both the aperture and the slit are dimensioned and configured to receive at least one securing protrusion of the at least one compatible, interchangeable, and adjustable holster accessory slidably adjustable between a plurality of orientations, enabling the holster body to be slidably adjustable and securable relative to the at least one compatible, interchangeable, and adjustable holster accessory;

thereby rendering the holster interchangeably locatable and usable adjustably for a left- and a right-handed user on a user's body.

2. The holster as claimed in claim 1, wherein the first and the second adjustable attachment formations comprise a plurality of apertures, configured to receive the at least one securing protrusion of the at least one compatible, interchangeable, and adjustable holster accessory.

3. The holster as claimed in claim 1, wherein the first and the second adjustable attachment formations comprise at least one circular aperture and at least one kidney-shaped slit, rendering a position of the holster body slidably adjustable and securable, both in a plane parallel to, rotatably around an axis with, and angularly transversely relative to the at least one compatible, interchangeable, and adjustable holster accessory.

4. The holster as claimed in claim 1, wherein the cavity of the holster body is contoured to fit closely with an exterior profile of the preselected handgun.

5. The holster as claimed in claim 4, wherein the cavity is contoured to receive the preselected handgun snugly, frictionally therein, thereby enabling the holster body to provide frictional resistance against insertion and removal of the preselected handgun from the holster body.

6. The holster as claimed in claim 1, wherein the holster body further comprises three adjacent walls, contoured to fit closely around an exterior profile of the preselected handgun, wherein the three adjacent walls defining a top wall, a first and a second, opposing side wall, collectively providing a longitudinal channel with an open rear and an opposing, open front end, with the first and second opposing side walls terminating oppositely the top wall in a longitudinal slot, extending at least partially between the open rear and the opposing, open front end, wherein the longitudinal slot defines a bottom of the holster body.

7. The holster as claimed in claim 6, wherein the first and the second opposing side walls terminate in corresponding, opposed first and second flanges, extending at least partially along the longitudinal slot.

8. The holster as claimed in claim 7, wherein the opposed first and the second flanges are provided with corresponding, adjustable attachment formations, dimensioned and configured to secure the opposed first and second flanges at a preselected, adjustable distance to each other.

9. The holster as claimed in claim 8, wherein the adjustable attachment formations are dimensioned and configured to adjust the preselected, adjustable distance between the opposed first and second flanges, and thereby a circumference of the holster body, to a preselected level, thereby adjusting a frictional resistance of the holster body against insertion and removal of the preselected handgun from the holster body.

10. The holster as claimed in claim 6, wherein the holster body further comprises a relatively thin-walled, single sheet of resiliently flexible, material, sufficiently rigid and suitably dimensioned and configured to define the three adjacent walls, with the top wall, the first and the second, opposing side walls integrally linked to provide collectively the longitudinal channel with the open rear and the opposing, open front end, with the first and second opposing side walls terminating oppositely the top wall in the longitudinal slot.

11. The holster as claimed in claim 10, wherein the relatively thin-walled, single sheet of resiliently flexible material is selected from a group consisting of plastic polymers and metal alloys.

12. The holster as claimed in claim 1, wherein the at least one compatible, interchangeable, and adjustable holster accessory is selected from the group consisting of an interchangeable, adjustable belt clip, waistband clip, belt spacer assembly and cover plate, rendering the at least one compatible, interchangeable, and adjustable holster accessory operatively securable, adjustably and interchangeably, to the opposing sides of the holster body via the first and the second adjustable attachment formations.

13. A kit for a versatile, passive retention holster, the kit including a holster body and at least one compatible, interchangeable and adjustable holster accessory, wherein the holster body comprises a cavity, dimensioned and configured to releasably receive and retain a preselected handgun frictionally therein, wherein the holster body further comprises a first adjustable attachment formation, located on one side of the holster body, wherein the first adjustable attachment formation is dimensioned and configured to render the holster body operatively securable, adjustably to the at least one compatible, interchangeable, and adjustable holster accessory; and a second adjustable attachment formation, located on an opposing side of the holster body, relative to the first adjustable attachment formation, wherein the second adjustable attachment formation is dimensioned and configured to render the holster body operatively securable, adjustably, to the at least one compatible, interchangeable, and adjustable holster accessory; and wherein the at least one compatible, interchangeable, and adjustable holster accessory comprises a corresponding attachment formation, correspondingly dimensioned and configured to render the at least one compatible, interchangeable, and adjustable holster accessory operatively securable, adjustably and interchangeably, to the opposing sides of the holster body via the first and the second adjustable attachment formations; and wherein the first and the second attachment formations comprise at least one aperture and at least one angled slit, wherein both the aperture and the slit are dimensioned and configured to receive at least one securing protrusion of the at least one compatible, interchangeable, and adjustable holster accessory slidably adjustable between a plurality of orientations, enabling the holster body to be slidably adjustable and securable relative to the at least one compatible, interchangeable, and adjustable holster accessory;

thereby rendering the holster interchangeably locatable and usable, adjustably, for a left- and a right-handed user on a user's body.

* * * * *